United States Patent [19]

Horie et al.

[11] Patent Number: 4,791,877

[45] Date of Patent: Dec. 20, 1988

[54] FEED CONTROL DEVICE FOR AN ELECTRONICALLY CONTROLLED ZIGZAG SEWING MACHINE

[75] Inventors: Fujio Horie, Nagoya; Kenji Matsubara, Inuyama, both of Japan

[73] Assignee: Brother Kogyo Kabushiki Kaisha, Aichi, Japan

[21] Appl. No.: 121,237

[22] Filed: Nov. 16, 1987

[30] Foreign Application Priority Data

Nov. 15, 1986 [JP] Japan ..... 61-272666

[51] Int. Cl.[4] ..... D05B 3/02

[52] U.S. Cl. ..... 112/456; 112/315; 112/304; 112/322

[58] Field of Search ..... 112/314, 315, 318, 322, 112/303, 456, 453, 121.12, 254, 304, 241

[56] References Cited

U.S. PATENT DOCUMENTS

| | | | |
|---|---|---|---|
| 3,982,491 | 9/1976 | Herzer et al. | 112/121.12 |
| 4,236,469 | 12/1980 | Takenoya et al. | 112/314 X |
| 4,286,532 | 9/1981 | Tonomura | 112/314 |
| 4,295,435 | 10/1981 | Uemura et al. | 112/322 |
| 4,318,360 | 3/1982 | Uemura et al. | 112/318 |
| 4,340,002 | 7/1982 | Hanyu et al. | 112/453 |
| 4,459,926 | 7/1984 | Ohniwa | 112/121.12 |
| 4,495,877 | 1/1985 | Willenbacher | 112/315 X |
| 4,616,583 | 10/1986 | Takano et al. | 112/314 X |
| 4,625,667 | 12/1986 | Hammermann | 112/456 |
| 4,683,827 | 8/1987 | Kinoshita et al. | 112/453 |
| 4,696,247 | 9/1987 | Horie | 112/456 X |
| 4,721,050 | 1/1988 | Naganuma et al. | 112/318 X |

FOREIGN PATENT DOCUMENTS

| | | |
|---|---|---|
| 2927869 | 1/1980 | Fed. Rep. of Germany . |
| 59-59952 | 9/1982 | Japan . |
| 59-149178 | 2/1983 | Japan . |
| 1470678 | 4/1977 | United Kingdom . |
| 2070652 | 9/1981 | United Kingdom . |

*Primary Examiner*—Peter Nerbun

*Attorney, Agent, or Firm*—Barnes & Thornburg

[57] ABSTRACT

The start and end timing of fabric feed in a sewing machine greatly affects the tightening of needle thread, that is, the sewing quality. Among the electronically controlled zigzag sewing machines, those equipped with feed means directly driven by a pulse motor supplied with command pulses, it has become possible to control freely the start and end timing of fabric feed. Disclosed is a feed control device for an electronically controlled zigzag sewing machine comprising pulse train generating means for generating feed command pulse train in a predetermined pulse train pattern depending on the number of pulses corresponding to the feed stroke of the work fabric and the speed of the main motor, and pulse train generation control means for controlling the start of operation of the pulse train generating means according to the speed of the main motor so that the vertical motion phase of the needle at the end of generation of the command pulse train by the pulse train generating means may be delayed the more as the speed of the main motor is the faster.

9 Claims, 7 Drawing Sheets

FEED CONTROL DEVICE FOR AN ELECTRONICALLY CONTROLLED ZIGZAG SEWING MACHINE

BACKGROUND OF THE INVENTION

This invention relates to a feed control device for an electronically controlled zigzag sewing machine, and more particularly to a feed control device for a feed device which is directly driven by a pulse motor.

In a conventional electronically controlled zigzag sewing machine, generally, the needle bar reciprocating mechanism and feed dog vertical motion mechanism for fabric feed were driven by the main motor, while the needle bar swinging mechanism and feed dog driving mechanism were driven by individual pulse motors.

Recently, zigzag sewing machines capable of controlling the fabric feed accurately based on the latest required feed stroke by directly driving the feed dog driving mechanism by an independent pulse motor to simplify the driving system have been proposed.

For example, the U.S. Pat. No. 4,286,532 discloses a feed device driven independently from the sewing machine upper shaft, in which the rotation phase of the sewing machine upper shaft is detected by an upper shaft phase signal generator, the rotation phase of the feed shaft of the feed dog is predetermined to correspond to the rotation phase of the upper shaft, and the rotation phase of the feed shaft is controlled to agree with the predetermined rotation phase depending on an upper shaft phase signal, so that the end timing of fabric feed is controlled constantly.

In this feed device, although the end timing of fabric feed can be adequately controlled, it requires the upper shaft phase signal generator for detecting the rotation phase of the sewing machine upper shaft and electric signal means for setting the rotation phase of the feed shaft so as to correspond with the rotation phase of the upper shaft, and the constitution of the device is complicated, and the manufacturing cost is higher.

The present applicant, therefore, previously proposed a feed device of a sewing machine (the U.S. Ser. No. 06/931 853) now U.S. Pat. No. 4,721,050 in which the start timing and end timing of fabric feed are controlled constantly regardless of the sewing machine speed, by calculating the period of the command pulses of the feed pulse motor according to the speed signal corresponding to the actual speed or set speed of the main motor and the feed stroke signal for feeding the fabric.

In the feed device of the sewing machine according to previous application, the period of the command pulses of the feed pulse motor is controlled longer when the speed of main motor is low or feed stroke is small, while the period of the command pulses is controlled shorter in case of high speed or large feed stroke, and by thus constantly controlling the end timing of fabric feed, the tightening of the needle thread by the thread take-up lever is kept constant.

However, only by controlling the end timing of fabric feed to be constant regardless of the rotating speed of the main motor, tightening of the thread in high speed operation is insufficient, and the tension of needle is unstable.

Even in the conventional sewing machine without controlling of the end timing of fabric feed constant, it is empirically known that the thread tightening is insufficient at high speed, and therefore an experienced operator adjusts to intensify the spring force of the tension disc in high speed operation.

Considering the reason of the insufficient tightening in high speed operation, the thread tightening time is extremely short in high speed operation, and the ascending speed of the thread take-up lever is extremely raised so that the thread cannot move smoothly toward the tension disc through the guide hole of the thread take-up lever when tightening the needle thread, thereby causing the needle thread to be somewhat supplied through the tension disc.

Furthermore, when the start timing of fabric feed is controlled constant regardless of the speed of the main motor or fabric feed stroke, the feed end timing is earlier when the speed is low or the feed stroke is small, which may result in disturbance of the thread tension.

SUMMARY OF THE INVENTION

It is hence a primary object of the present invention to present a feed control device for an electronically controlled zigzag sewing machine capable of controlling the thread tension to be constant regardless of the rotating speed of the main motor or the feed stroke of the work fabric.

To achieve the above object, the present invention relates to a feed control device for an electronically controlled zigzag sewing machine including a needle reciprocated up and down by a main motor with a variable speed, feed means directly driven by a pulse motor for feeding the work fabric in timed with the vertical motion of the needle, pulse motor driving means for driving the pulse motor in response to the command pulse train of the number of pulses corresponding to the feed stroke of the work fabric, a thread take-up member operating in timed with the vertical motion of the needle in order to take-up the thread loop formed in the eye of the needle, and speed setting means for setting the speed of the main motor; the feed control device comprising: pulse train generating means for generating the command pulse train in a pulse train pattern predetermined depending on the number of pulses corresponding to the feed stroke of the fabric and the speed of main motor, and pulse train generation control means for controlling the start of operation of the pulse train generating means according to the speed of the main motor so that the vertical motion phase of the needle at the end of generation of command pulse train by the pulse train generating means may be delayed with increasing speed of the main motor.

In the feed control device for an electronically controlled zigzag sewing machine according to the present invention, the fabric is fed by the feed means directly driven by the pulse motor in synchronism with the needle reciprocated up and down by the main motor with a variable speed, and the thread loop formed in the eye of the needle is taken up by the thread take-up member.

By the pulse train generating means, a command pulse train is prepared in a predetermined pulse train pattern depending on the number of pulses corresponding to the feed stroke of the fabric and the speed of the main motor and the pulse motor is driven by this pulse train through the pulse motor driving means.

In order that the vertical motion phase of the needle at the end of supply of the command pulse train may be delayed the more as the speed of the main motor is the faster, the supply start timing of the command pulse train of the pulse train generating means is controlled depending on the speed of the main motor by means of the pulse train generation control means.

That is, the pulse motor is driven by the pulse motor driving means in response to the pulse train supplied from the timing controlled by the pulse train generation control means.

Describing more practically according to FIG. 5 relating to this embodiment, it is most preferable that the feed of fabric be executed after the needle thread is sufficiently tightened by the thread take-up member (thread take-up lever), but since the period from the moment the thread take-up member reaches the highest position until the needle-fabric coincidence point is very short, the fabric feed is executed parallel to the tightening of the needle thread.

In FIG. 5, line segments F of four groups denote the pulse train generation periods (feed periods), and the numeral at the right end of each line segment F represents the number of pulses of the pulse train (which corresponds to the feed stroke).

In this feed control device, owing to the functions of pulse train generating means and pulse train generation control means, when the speed is constant as shown in FIG. 5, the feed is started at a later timing when the number of pulses is smaller, so that the end timing of feed becomes an almost constant timing extremely delayed. In order that the feed time length may not vary significantly depending on the speed of the main motor, the feed is started at a faster timing in high speed operation than in low speed operation if the number of pulses may be identical.

Furthermore, if the number of pulses is the same, since the feed is terminated at a later timing in high speed operation than in low speed operation and moreover at a nearly finished moment of tightening by the thread take-up member, the tightening of the needle thread in high speed operation is executed securely, so that the thread tension may be stabilized.

According to the feed control device for an electronically controlled zigzag sewing machine of the present invention, as described herein before, since the supply start timing of the command pulse train is controlled so that the vertical motion phase of the needle at the end of supply of command pulse train is delayed the more as the speed of the main motor is the faster, the needle thread may be sufficiently tightened even when the rotating speed of the main motor is fast, so that the thread tension may be stabilized.

Furthermore, when controlling to start the operation of pulse train generating means (feed start) depending on the feed stroke of the fabric and its feed direction, the feed end timing is optimally controlled, so that the thread tension may be stabilized by properly tightening the needle thread regardless of the feed stroke or feed direction.

BRIEF DESCRIPTION OF THE DRAWINGS

FIG. 1 to FIG. 6 illustrate the embodiment of the present invention, in which

FIG. 1 is a fragmentary sectional front elevation of a pressure foot on the bed and a feed device provided in the bed of an electronically controlled zigzag sewing machine;

FIG. 2 is a side elevation of that shown in FIG. 1;

FIG. 3 is a plan view of the feed device shown FIG. 1 and FIG. 2;

FIG. 4 is a block diagram of the control device of the sewing machine;

FIG. 5 is a diagram showing the vertical motion curve of thread take-up lever, needle vertical motion curve, and start and end timing of fabric feed; and FIGS. 6A and 6B are a schematic flow chart of a control routine of feed control.

DESCRIPTION OF THE PREFERRED EMBODIMENT

A preferred embodiment of the present invention will be described hereinafter with reference to the accompanying drawings.

This embodiment relates to a feed device and its feed control device of an electronically controlled zigzag sewing machine constituted to drive the fabric directly by a pulse motor in synchronism with the vertical reciprocative motion of the needle, and constituted to control the start timing and end timing of feed on the basis of the speed of main motor and the feed stroke and feed direction.

Figure 1:
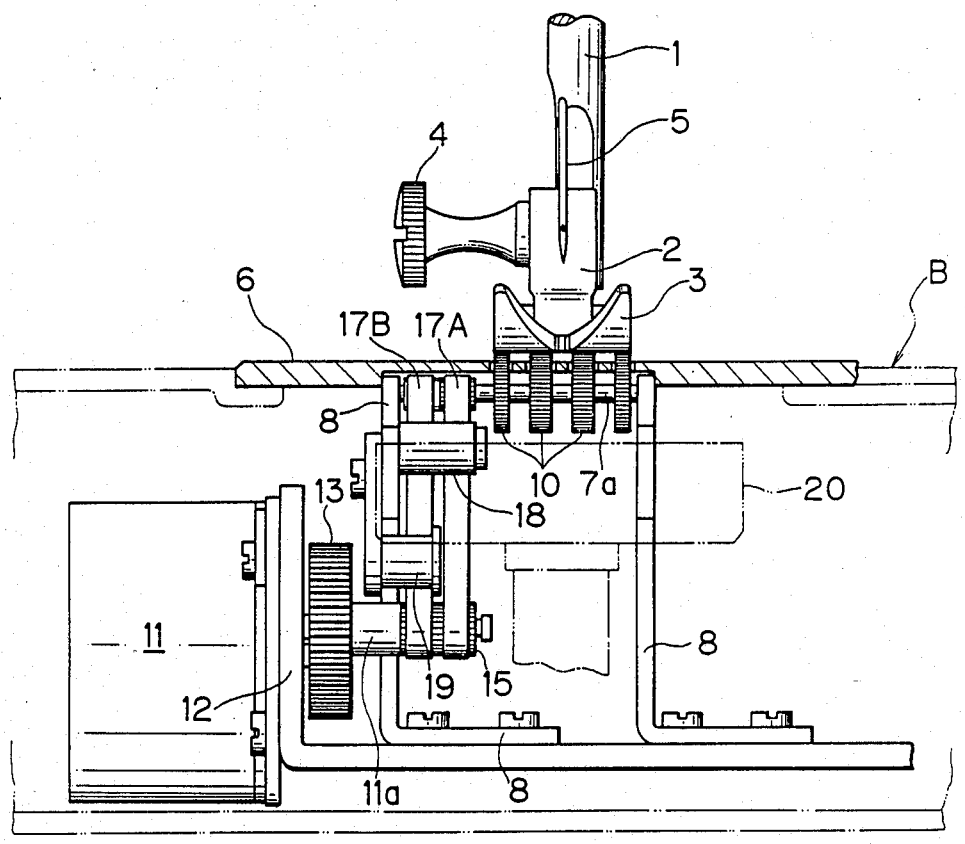
Figure 2:
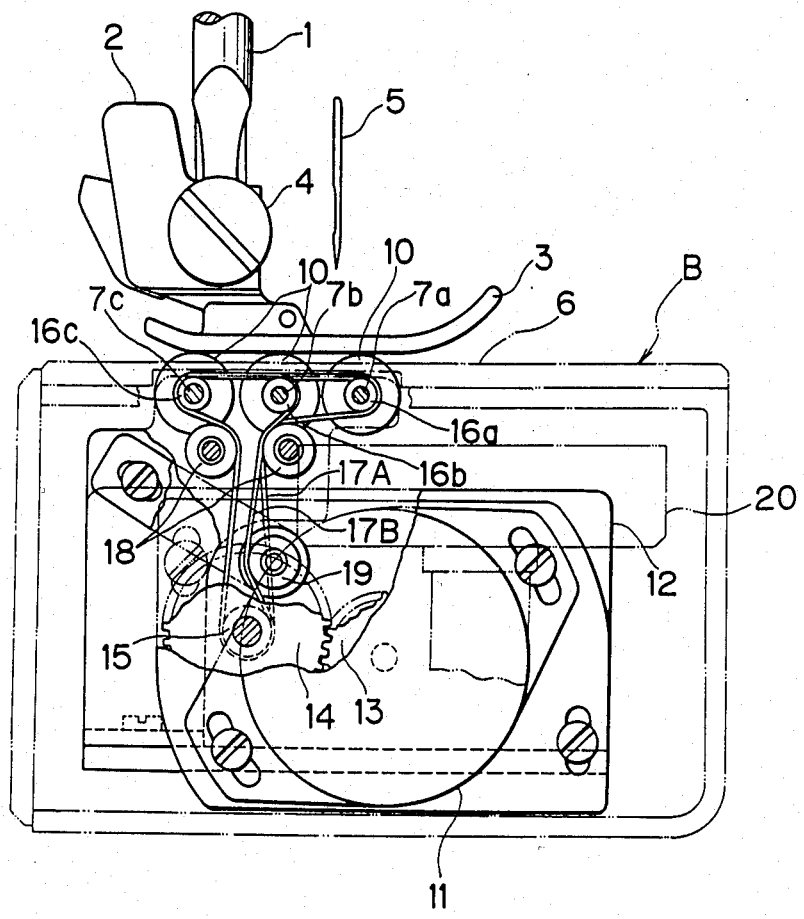
Figure 3:
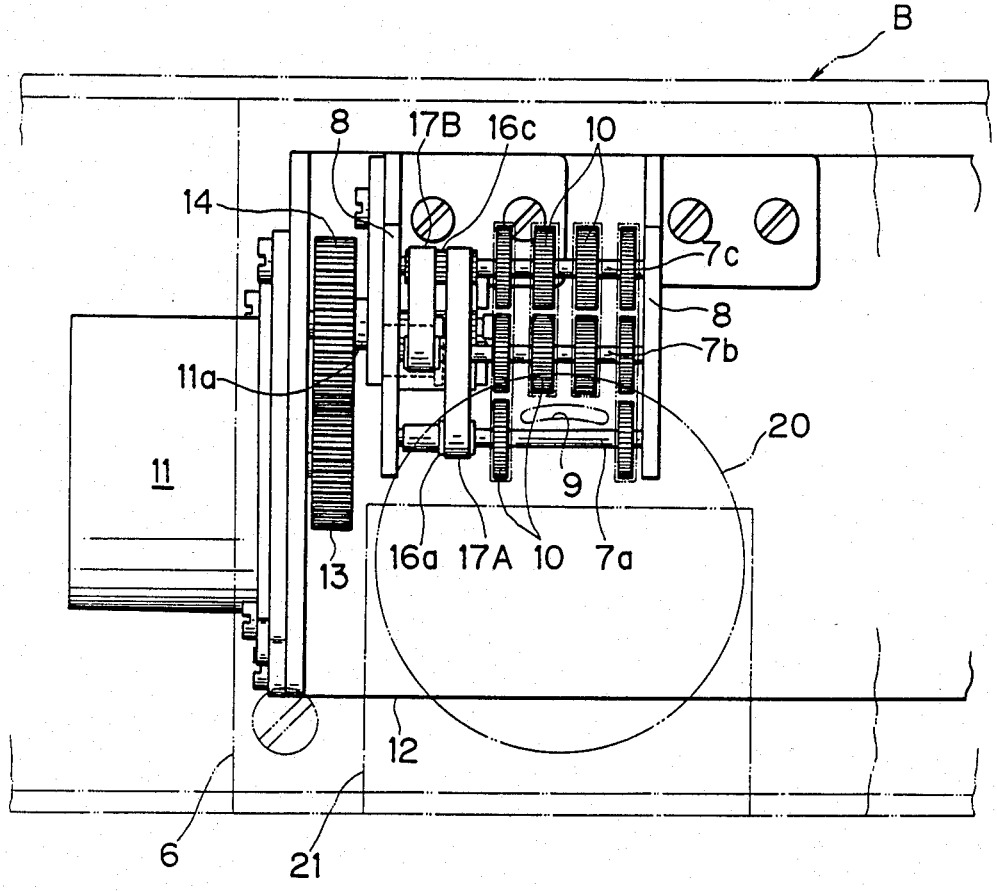

A feed device embodying the present invention, for an electronically controlled zigzag sewing machine feeds a work fabric with the members directly driven by a stepping motor. The period of command pulses for driving the stepping motor is controlled on the basis of the rotating speed of the main motor of the sewing machine. The needle bar reciprocating mechanism and the thread take-up lever are driven by the main motor, while the feed mechanism having feed rollers partly projecting from the upper surface of the throat plate is driven directly by the stepping motor. Since the needle bar reciprocating mechanism and the thread take-up lever are substantially the same as those of the ordinary electronically controlled pattern sewing machine, the description thereof will be omitted, and the feed device will be described herein with reference to FIGS. 1 to 3.

A presser foot holder 2 is fastened with a screw 4 to the lower end of a presser bar 1 extending downward from the top of the arm of a electronically controlled zigzag sewing machine. A presser foot 3 is attached detachably to the presser holder 2. A needle 5 is attached to a needle bat (not shown) extending in front of the presser bar 1.

A roller type feed device having the following constitution is disposed in the bed B below the presser bar 1 and the needle bar.

Three parallel shafts 7*a*, 7*b* and 7*c* are disposed at appropriate internals in the feed direction under a throat plate 6 with their axes perpendicular to the feed direction in a space corresponding to an area somewhat behind the central portion of the throat plate 6 and an area below the presser foot 3 and the left-hand side of the same. The shafts 7*a*, 7*b* and 7*c* each is supported rotatably at the opposite ends thereof on brackets 8 provided inside a bed B.

Under the presser foot 3, a pair of rollers 10 are secured to the front shaft 7*a* on opposite sides of a needle slot 9, while four rollers 10 are secured to each of the rear shafts 7*b* and 7*c*. The rollers 10 protrude slightly from the upper surface of the throat plate 6 through openings formed in the throat plate 6, respectively. A work is held between the presser foot 3 and the rollers 10, and the rollers 10 are rotated to feed the work.

A stepping motor 11 for rotatively driving the shafts 7*a*, 7*b* and 7*c*, hence the rollers 10, to feed the work is attached to a bracket 12 provided in the bed B with the axis of the motor shaft 11a in parallel to those of the shafts 7a, 7b and 7c. A driving gear 13 is secured to the motor shaft 11a. A driven gear 14 engaging the driving gear 13 is supported rotatably on the brackets 8 and 12. A pulley 15 is secured to the shaft of the driven gear 14, while pulleys 16a, 16b and 16c are secured to the shafts 7a, 7b and 7c, respectively. A timing belt 17A is extended around the pulleys 15, 16a and 16c, while a timing belt 17B is extended around the pulleys 15, 16b and 16c. A pair of idle pulleys 18 are provided to guide the timing belts 17A and 17B. A tension pulley 19 is provided to adjust the tension of the timing belt 17B. Thus, the rollers 10 secured to the shafts 7a, 7b and 7c, respectively, are rotated through the timing belts 17A and 17B by the stepping motor 11. The respective circumferences of the rollers 10 are serrated to prevent the slip of the work relative to the rollers 10. Indicated at 20 is a horizontal shuttle race body for accommodating a bobbin, and at 21 is a slide plate.

It is also possible to provide flexible belts of an abrasion-resistant metal or synthetic resin, instead of the rollers 10, in the area where the rollers 10 are disposed, and to drive the flexible belts by the stepping motor 11, or to provide a feed dog of an ordinary sewing machine, and to drive the feed dog for horizontal and vertical movement by the stepping motor 11. Essentially, the feed device is driven directly by the stepping motor 11.

Figure 4:
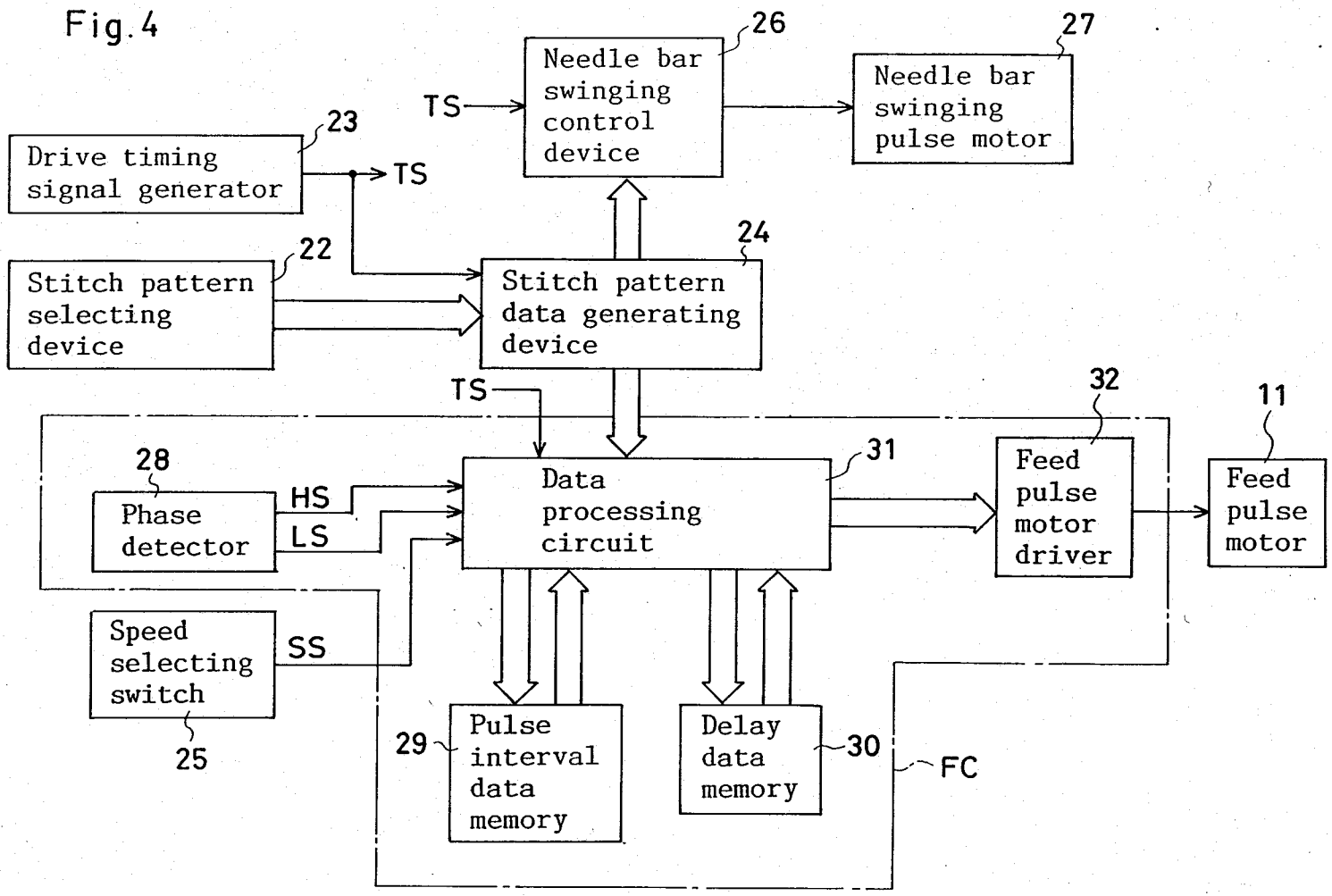

The control device for controlling the pulse motor 11 for feeding the work fabric and the pulse motor for swinging the needle bar will be described hereinafter with reference to the block diagram in FIG. 4.

The control device for controlling the feed pulse motor 11 and needle bar swinging pulse motor 27 comprises a stitch pattern selecting device 22, a drive timing signal generator 23, a stitch pattern data generating device 24, a speed selecting switch 25, a needle bar swinging control device 26, and a feed control means FC.

The drive timing signal generator 23 detects the needle uppermost position in every cycle of the needle bar vertical motion by means of a limit switch or a photo interruptor, and its drive timing signal TS is supplied to the stitch pattern data generating device 24, the needle bar swinging control device 26, and a data processing circuit 31 of the feed control means FC.

The stitch pattern data generating device 24 stores, for each stitch pattern among multiple stitch patterns, the data of the feed stroke (the number of drive pulses for driving the feed pulse motor 11) of each stitch motion, the data of the needle bar swinging stroke (the needle swinging stroke, that is, the number of drive pulses for driving the needle bar swinging pulse motor 27) of each stitch motion and the data of their direction (feed direction and needle swinging direction) in a group of addresses, and the stitch pattern selecting device 22 is for selecting the stitch pattern stored in the stitch pattern data generating device 24 by using a code number or the like, and supplies the stitch pattern selecting signal to the stitch pattern data generating device 24.

The speed selecting switch 25 is a two-position selector for changing the rotating speed of the main motor (not shown) between high speed and low speed, and a speed selecting signal SS is supplied to the data processing circuit 31, and the main motor is driven at high speed or low speed depending on the "H" or "L" level of the speed selecting signal.

The needle bar swinging control device 26 comprises a needle bar swinging pulse motor driver, and it sequentially reads in the needle swinging data (the number of drive pulses and needle swinging direction data) from the stitch pattern data generating device 24 instructed by the stitch pattern selecting signal, and delivers a series of control signals corresponding to the needle swinging data at specified timing determined on the basis of the drive timing signal TS to the needle bar swinging pulse motor 27, thereby swinging the needle bar.

The control of the needle bar winging pulse motor 27 on the basis of the stitch pattern data is basically same as that in the existing electronically controlled zigzag sewing machine and is not specifically described herein, while the feed control means FC for controlling the feed pulse motor 11 is explained in details below.

The feed control means FC comprises a phase detector 28, a pulse interval data memory 29, a delay data memory 30, a data processing circuit 31, and a feed pulse motor driver 32.

Figure 5:
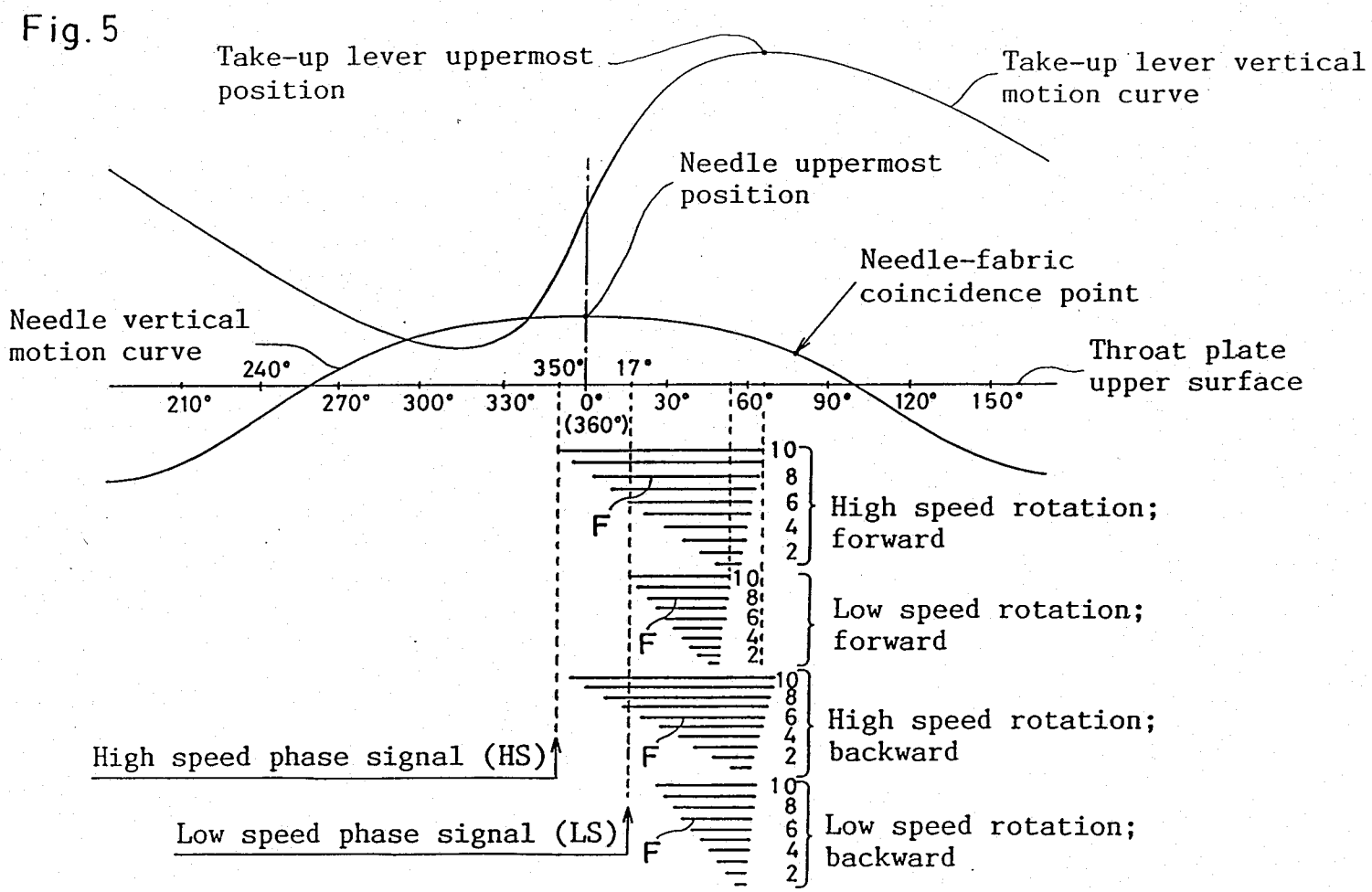

The phase detector 28 comprises, as shown in FIG. 5, a high speed sensor for detecting the phase 10° earlier than the drive timing signal TS, that is, the phase of 350°, and a low speed sensor for detecting the phase 17° later than the drive timing signal TS, that is, the phase of 17°, in every cycle of needle bar vertical motion, with respect to the phase of the main shaft driven by the main motor, and the high speed sensor supplies a high speed phase signal HS, and the low speed sensor supplies a low speed phase signal LS, and these high speed and low speed sensors are composed of operating pieces mounted on the main shaft and limit switches or photo interruptors, and the high speed phase signal HS and low speed phase signal LS are delivered to the data processing circuit 31.

The pulse interval data memory 29 comprises a ROM (read only memory), and in this pulse interval data memory 29 are preliminarily stored the data of respective pulse intervals of driving pulses for driving the feed pulse motor 11 on the basis of the main motor rotating speed (high speed or low speed) and the feed stroke (however, self-starting frequency for starting up the pulse motor 11 and continuous response frequency after start-up are considered in the pulse intervals).

The delay data memory 30 comprises a ROM, and in this delay data memory 30 are preliminarily stored, as shown in FIG. 5, the delay time data from the input of the high speed phase signal HS till drive starting of the feed pulse motor 11 in high speed rotation, and the delay time data from input of low speed phase signal LS till drive starting of the feed pulse motor 11 in low speed rotation, using the main motor rotating speed, the feed stroke and the feed direction (forward or backward) as parameters.

The data processing circuit 31 comprises a microcomputer including a CPU (central processing unit), a ROM, and a RAM (random access memory), and a control program for controlling the feed pulse motor 11 is stored in the ROM, and the CPU reads the specified delay time data from the delay data memory 30 on the basis of the speed selecting signal SS, the number of drive pulses of fabric feed, the feed direction data, and the high speed phase signal HS or the low speed phase signal LS, and, upon lapse of the delay time after the input of high speed phase signal HS or low speed phase signal LS, supplies a series of control pulse trains (consisting of pulses of the number of drive pulses) with a pulse interval corresponding to the data of specified pulse interval read in from the pulse interval data memory 29 to the feed pulse motor driver 32.

Thus, the feed pulse motor 11 is driven by drive pulses delivered from the feed pulses motor driver 32.

Hereinafter, description relates to the feed control for delaying the feed end timing when the main motor is rotating at high speed than the feed end timing during low speed rotation, on the basis of the rotating speed of the main motor. FIG. 5 shows the vertical motion curve of the needle 5 and the vertical motion curve of the thread take-up lever which moves up and down in synchronism with the vertical motion of the needle 5, in which it is desired to execute the fabric feed at least after the needle 5 has reached the vicinity of the uppermost position, and it is necessary that the fabric feed be over until the descending needle 5 pierces into the fabric.

Besides, it is most preferable to feed the fabric after the needle thread has been sufficiently tightened by the thread take-up lever, but since the period from the moment the thread take-up lever reaches the uppermost point until the needle-fabric coincidence point is relatively short, especially this period is very short when the rotating speed of the main motor is fast, it is difficult to feed the fabric in this period, and therefore the fabric feed is effected, parallel to the tightening of the needle thread by the thread take-up lever until the moment of needle-fabric coincidence.

In FIG. 5, the line segments F of four groups denote the pulse train generating period (feed period), and the numeral attached to the right end of each line segment F represents the number of pulses of pulse train (corresponding to the feed stroke).

As shown in FIG. 5, when the speeds are identical, the smaller the number of pulses becomes, the later the start timing of fabric feed becomes, thus the feed end timing is delayed maximally, so that the end timing becomes approximately constant. In order that the fabric feed time length may not vary significantly due to the speed of main motor, if the number of pulses is the same, the fabric feed is started at an earlier timing in high speed operation than in low speed operation.

Furthermore, provided the number of pulses be the same, since the fabric feed is over at a later timing in high speed operation than in low speed operation and at the point when the tightening by thread take-up lever is nearly complete, the needle thread is tightened securely in high speed operation, and the thread tension is stabilized.

When feeding backward, the feed end timing is delayed than feeding forward with considering slipping of the fabric.

Figure 6:
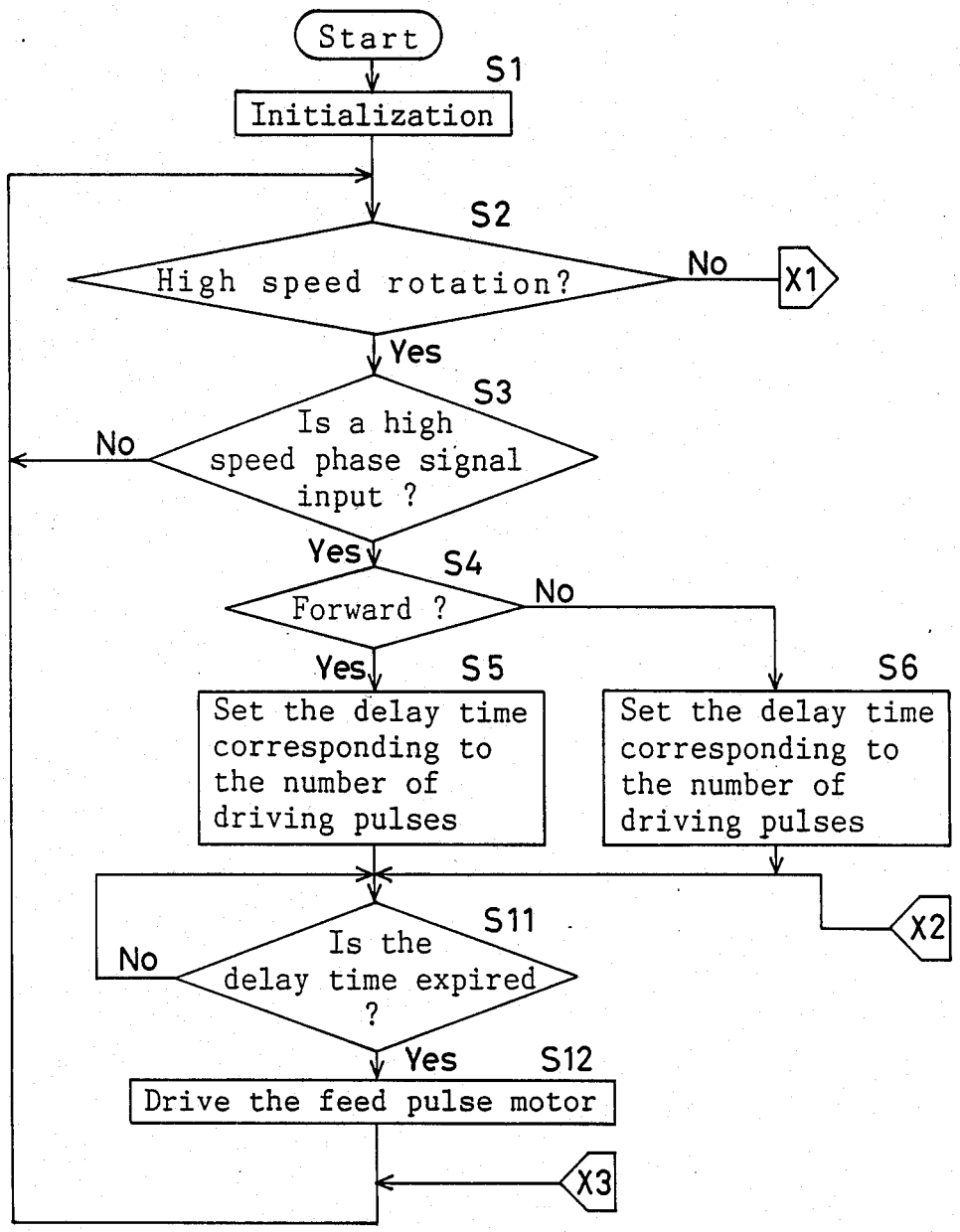
Figure 6:
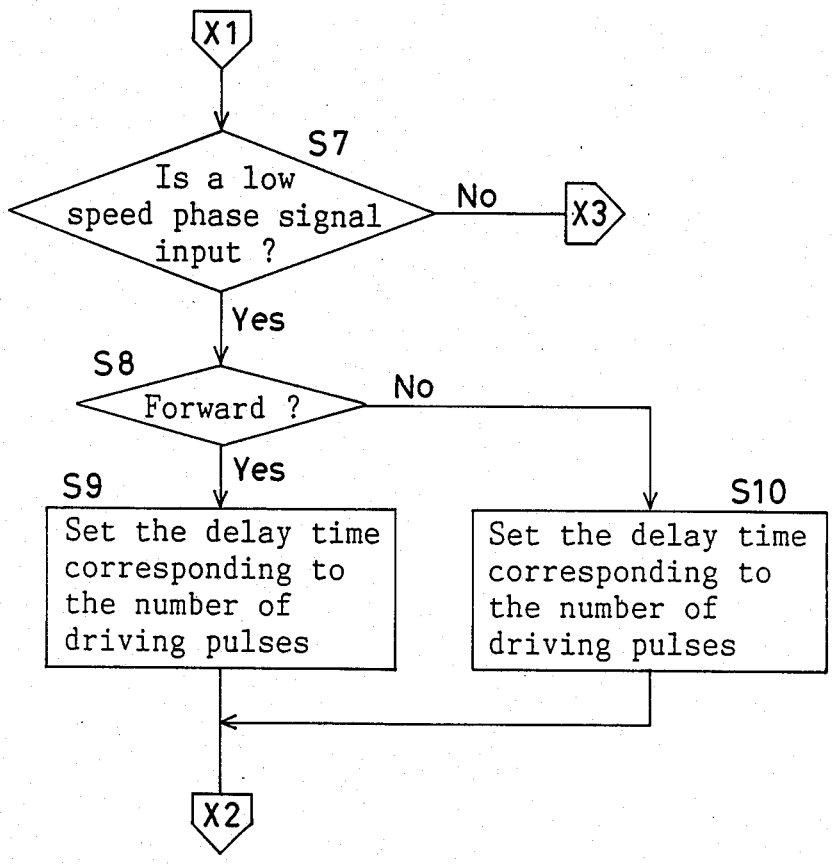

Referring now to the flow chart in FIG. 6, the routine of feed control is explained below. This feed control program is preliminarily stored in the ROM of the data processing circuit 31.

Simultaneously with the start of sewing operation, control is started up at the CPU of the data processing circuit 31, and, at step S1 (hereinafter expressed as S1, so are other steps similarly), initialization is executed, thereby proceeding to S2.

At S2, according to the signal level of the speed selecting signal SS, a decision is made as to whether the rotation is high speed or not, and when the rotation is low speed, the operation proceeds to S7, and in the case of high speed, it proceeds to S3.

At S3, a decision is made as to whether or not the high speed phase signal HS is supplied from the high speed sensor, and when the decision at S3 is no operations of S2 to S3 are repeated, and when high speed phase signal HS is input, the operation proceeds to S4.

At S4, according to the feed direction data delivered from the stitch pattern data generating device 24, a judgement is made whether the feed direction is forward or not, and when the feed direction is backward, the operation proceeds to S6, and when forward, it proceeds to S5.

In case of feeding forward, at S5, depending on the speed selecting signal SS, and the feed direction data and drive pulse count data read out from the stitch pattern data generating device 24, a specified delay time is read out from the delay data memory 30, and the delay time is set in the internal timer in the CPU, and the operation proceeds to S11.

In case of feeding backward, at S6, similar to S5, a specified delay time is read out from the delay data memory 30 according to the speed selecting signal SS and feed direction data and drive pulse count data, and this delay time is set in the internal timer, and the routine proceeds to S11.

On the other hand, when the operation is not high speed, the routine jumps from S2 to S7, where a decision is made whether the low speed phase signal LS is entered from the low speed sensor or not, and if no, steps S2 and S7 are repeated, and when entered, the operation proceeds to S8.

At S8, according to the feed direction data delivered from the stitch pattern data generating device 24, a judgement is made whether the feed direction is forward or not, and when the feed direction is backward, the operation proceeds to S10, and when forward, the routine advances to S9.

In case of feeding forward, at S9, on the basis of the speed selecting signal SS, and the feed direction data and drive pulse count data read out from the stitch pattern data generating device 24, a specified delay time is read out from the delay data memory 30, and this delay time is set in the internal timer in the CPU, and the operation proceeds to S11.

In case of feeding backward, at S10, a specified delay time is similarly read out from the delay data memory 30 on the basis of the speed selecting signal SS and the feed direction data and drive pulse count data, and the delay time is set in the internal timer, and the operation proceeds to S11.

At S11, it is judged whether the delay time set at S5, S6, S9, S10 has expired or not, and if no, S11 is repeated, and if yes, the routine advances to S12.

At S12, according to the speed selecting signal SS and the feed direction data and drive pulse count data, a control pulse train with pulse interval corresponding to the pulse interval data read out from the pulse interval data memory 29 is delivered to the feed pulse motor driver 32, and a drive pulse is supplied from the feed pulse motor driver 32 to the feed pulse motor 11, and the feed pulse motor 11 is driven to feed the fabric (see FIG. 5).

When fabric feed is over, the operation returns from S12 to S2. Thereafter, S2 to S12 are repeated, and the fabric is fed sequentially. In this embodiment, in high speed rotation and low speed rotation of the main motor, the feed end timing is set on the basis of the delay time data of the delay data memory 30 and pulse interval data of the pulse interval data memory 29, but in a variable speed sewing machine in which the rotating speed of the main motor changes from low speed to high speed, the feed end timing may be obtained by calculation depending on the rotating speed of the main motor.

Of the control means for controlling the needle bar swinging pulse motor 27 and feed pulse motor 11, the stitch pattern data generating device 24, pulse interval data memory 29, delay data memory 30, and data processing circuit 31 may be constituted with a microcomputer, and in this case, the stitch pattern data of the stitch pattern data generating device 24 may be stored in its ROM.

What is claimed is:

1. A feed control device for an electronically controlled zigzag sewing machine including a needle reciprocated up and down by a main motor with a variable speed, feed means directly driven by a pulse motor for feeding a work fabric in synchronization with the vertical motion of said needle, pulse motor driving means for driving said pulse motor in response to a command pulse train of the number of pulses corresponding to a feed stroke of said work fabric, a thread take-up member driven in synchronization with the vertical motion of said needle in order to take-up the tread loop formed in the eye of the needle, and speed setting means for setting the speed of said main motor; said feed control device comprising:

pulse train generating means for generating said command pulse train according to a pulse train pattern predetermined depending on the speed of said main motor and the number of pulses corresponding to the feed stroke of said work fabric; and pulse train generation control means for controlling the start of operation of said pulse train generating means according to the speed of said main motor so that the vertical motion phase of said needle at the end of generation of said command pulse train by said pulse train generating means may be delayed with increasing speed of said main motor.

2. A feed control device for an electronically controlled zigzag sewing machine according to claim 1, wherein said pulse train generating means further comprises a pulse interval data memory for storing pulse interval data for determining said pulse train pattern according to the number of pulses included in said command pulse train and the speed of said main motor.

3. A feed control device for an electronically controlled zigzag sewing machine according to claim 1; wherein said pulse train generation control means controls the start of operation of said pulse train generating means according to the feed stroke and feed direction of said work fabric by said feed means.

4. A feed control device for an electronically controlled zigzag sewing machine according to claim 1; wherein said pulse train generation control means further comprises a phase detector which supplies a high speed phase signal in the phase earlier by about 10° than the phase where said needle reaches the uppermost position, and supplies a low speed phase signal in the phase later by about 17° than the phase where the needle reaches the uppermost position, in the phase of the main shaft driven by said main motor.

5. A feed control device for an electronically controlled zigzag sewing machine according to claim 4; wherein said pulse train generation control means further comprises a delay data memory storing delay time data from the input of said high speed phase signal until generation of said command pulse train and delay time data from the input of said low speed phase signal until generation of said command pulse train, which are predetermined according to the feed stroke of said work fabric and the speed of said main motor and the feed direction.

6. A feed control device for an electronically controlled zigzag sewing machine according to claim 1; wherein said pulse train generation control means controls the start of operation of said pulse train generating means so that the vertical motion phase of said needle, upon start of generation of said command pulse train, may be delayed with decreasing feed stroke, provided that the speed of said main motor is constant.

7. A feed control device for an electronically controlled zigzag sewing machine according to claim 1; wherein said pulse train generation control means controls the start of operation of said pulse train generating means so that the vertical motion phase of said needle, upon start of generation of said command pulse train, may be advanced with increasing speed of said main motor, provided that the feed stroke of said work fabric is constant.

8. A feed control device for an electronically controlled zigzag sewing machine according to claim 1; wherein said pulse train generation control means controls said pulse train generating means so that the vertical motion phase of said needle upon end of generation of said command pulse train may be delayed more in the backward feed than in the forward feed.

9. A feed control device for an electronically controlled zigzag sewing machine including a needle reciprocated up and down by a main motor with a variable speed, feed means directly driven by a pulse motor for feeding a work fabric in synchronization with the vertical motion of said needle, pulse motor driving means for driving said pulse motor in response to a command pulse train of the number of pulses corresponding to a feed stroke of said work fabric, a thread take-up member operating in synchronization with the vertical motion of said needle in order to take-up the thread loop formed in the eye of the needle, speed setting means for setting the speed of said main motor, stitch pattern data generating means storing data directions in each stitch motion for each of multiple stitch patterns, and stitch pattern selecting means for selecting the stitch patterns stored in said stitch pattern data generating means; said feed control device comprising:

pulse train generating means for generating said command pulse train according to a pulse train pattern predetermined depending on the speed of said main motor and the number of pulses corresponding to the feed stroke of said work fabric; and pulse train generation control means for controlling the start of operation of said pulse train generating means according to the speed of said main motor so that the vertical motion phase of said needle at the end of generation of said command pulse train by said pulse train generating means may be delayed with increasing speed of said main motor.

* * * * *